US006077045A

United States Patent [19]

Kawada

[11] Patent Number: 6,077,045

[45] Date of Patent: Jun. 20, 2000

[54] SCROLL-TYPE COMPRESSOR AND OPERATION METHOD THEREFOR

[75] Inventor: Minoru Kawada, Nishi-kasugai-gun, Japan

[73] Assignee: Mitsubishi Heavy Industries, Ltd., Tokyo, Japan

[21] Appl. No.: 09/205,722

[22] Filed: Dec. 4, 1998

[30] Foreign Application Priority Data

Dec. 18, 1997 [JP] Japan ..... 9-363831

[51] Int. Cl.[7] ..... F04B 49/10

[52] U.S. Cl. ..... 417/32; 417/63

[58] Field of Search ..... 417/32, 63, 223, 417/18; 418/2, 69, 55.1–55.6

[56] References Cited

U.S. PATENT DOCUMENTS 4,820,130 4/1989 Eber et al. .
4,889,471 12/1989 Izunaga et al. .
5,256,042 10/1993 McCullough et al. ..... 418/1
5,640,854 6/1997 Fogt et al. ..... 62/197

FOREIGN PATENT DOCUMENTS 0 625 640 11/1994 European Pat. Off. .
4-303193 10/1992 Japan .
8-144985 6/1996 Japan .

*Primary Examiner*—Teresa Walberg
*Assistant Examiner*—Vinod D Patel
*Attorney, Agent, or Firm*—Olbon, Spivak, McClelland, Maier & Neustadt, P.C.

[57] ABSTRACT

A scroll-type compressor which prevents seizure or scuffing due to tight contact between spiral laps and end plates of fixed and revolving scrolls is provided. The compressor comprises two thermocouples, the contact point of one thermocouple being with a central portion of the end plate of the fixed scroll, while the contact point of the other thermocouple being with the housing. The operation of the scroll-type compressor is terminated when a difference between temperature values detected by the thermocouples reaches a predetermined value.

2 Claims, 2 Drawing Sheets

SCROLL-TYPE COMPRESSOR AND OPERATION METHOD THEREFOR

BACKGROUND OF THE INVENTION

1. Field of the Invention

The present invention relates to a compressor built in an air conditioner in a vehicle or the like.

This application is based on Patent Application No. Hei 9-363831 filed in Japan, the contents of which are incorporated herein by reference.

2. Description of the Related Art

FIG. 2 shows an example of a conventional scroll-type compressor. In this figure, reference numeral 1 indicates a housing which comprises cup-like main body 2, and front housing 6 fastened to the body 2 using a bolt (not shown). Rotational shaft 7 is supported by the front housing 6 via bearings 8 and 9, in a freely rotatable relationship.

Fixed scroll 10 and revolving scroll 14 are provided inside the housing 1. This fixed scroll 10 comprises end plate 11 and spiral lap 12 disposed on surface 11*a* of the plate 11, and the surface faces end plate 15 which is explained later. The end plate 11 is fastened to cup-like main body 2 via bolt 13.

In the above structure, the outer-peripheral surface of the end plate 11 is in close contact with the inner-peripheral surface of the cup-like main body 2, and thereby internal partitioning of housing 1 is established in a manner such that discharge cavity 31 is limitedly provided outside the end plate 11, while suction chamber 28 is limitedly provided inside the end plate 11.

On the other hand, a central part of end plate 11 is bored to provide discharge port 29, and opening and closing operations of this discharge port 29 are performed using discharge valve 30. The rising motion of discharge valve 30 is restricted by valve presser 32, and one end of both discharge valve 30 and valve presser 32 is fastened to end plate 11 via bolt 33.

The revolving scroll 14 comprises end plate 15 and spiral lap 16 which is disposed on surface 15*a* of the plate 15, and the surface faces the end plate 11. This spiral lap 16 has substantially the same shape as spiral lap 12 included in fixed scroll 10. The axes of the revolving and fixed scrolls 14 and 10 are separated from each other by a predetermined distance, that is, they are in an eccentric relationship. In addition, the phases of these scrolls differ by 180°, and they are engaged with each other as shown in FIG. 2.

Accordingly, tip seals 17, provided and buried at each head surface of spiral lap 12, are in close contact with surface 15*a* of end plate 15, while tip seals 18, provided and buried at each head surface of spiral lap 16, are in close contact with surface 11*a* of end plate 11. The side faces of spiral laps 12 and 16 make linear contact at plural positions and thus plural compression chambers 19*a* and 19*b* are formed essentially at positions of point symmetry with respect to the center of the spiral.

Inside projecting disk-shaped boss 20, provided at a center area in the outer surface (opposite to inner surface 15*a*) of end plate 15, drive bush 21 is inserted in a freely rotatable state via revolving bearing 23. Slide hole 24 is provided in the drive bush 21, and eccentric drive pin 25 is inserted into the slide hole 24 so as to perform a freely-sliding motion of the pin. The projecting drive pin 25 is eccentrically provided on an end face of larger-diameter portion 7*a* of rotational shaft 7, the portion 7*a* being provided on an end of the main body 2 side of the rotational shaft 7.

Between the peripheral edge of the outer surface of end plate 15 and an inner end face of front housing 6, thrust bearing 36 and Oldham link 26 are inserted.

In order to balance a dynamically unbalanced situation due to a revolving motion of the revolving scroll 14, balance weight 27 is attached to drive bush 21, and balance weight 37 is attached to the rotational shaft 7.

According to the above structure, when the rotational shaft 7 is rotated via clutch 3 which is connected with the shaft, revolving scroll 14 is driven via a revolving-radius variable mechanism consisting of eccentric drive pin 25, slide hole 24, drive bush 21, revolving bearing 23, boss 20, etc. The revolving scroll 14 revolves along a circular orbit having a radius of revolution, while rotation of the scroll 14 is prohibited by the Oldham link 26.

In this way, the above-mentioned line-contact portions in the side faces of spiral laps 12 and 16 gradually move toward the center of the "swirl", and thereby compression chambers 19*a* and 19*b* also move toward the center of the swirl while the volume of each chamber is gradually reduced.

Accordingly, gas, which has flowed into suction chamber 28 through an inlet (not shown), enters from an opening which is limited by the outer peripheral edges of spiral laps 12 and 16 to compression chambers 19*a* and 19*b*. This gas is gradually compressed and reaches central chamber 22. From the central chamber, the gas passes through discharge port 29, and presses and opens discharge valve 30, and thereby the gas is discharged into discharge cavity 31. The gas is then discharged outside via an outlet not shown.

If the above conventional scroll-type compressor is accelerated very rapidly under operational conditions with a high compression ratio, the temperature of compression chambers 19*a* and 19*b* also rises rapidly. Accordingly, both spiral laps 12 and 16 are thermally expanded, and the length of the teeth thereof also extends. However, the rise in the temperature of the housing 1 to which the fixed scroll 10 and revolving scroll 14 are attached is relatively slow; thus, expansion of the housing is also relatively small. As a result, the heads of spiral laps 12 and 16 may be tightly contacted with inner surfaces 15*a* and 11*a* of end plates 15 and 11, and accordingly, seizure or scuffing may occur at the contact section.

SUMMARY OF THE INVENTION

An object of the present invention is to solve the above problem related to seizure or scuffing due to tight contact between the spiral laps and the end plates.

Therefore, the present invention provides a compressor comprising a scroll-type compressor comprising a housing, and a fixed scroll and a revolving scroll in the housing, each scroll comprising an end plate and a spiral lap built on an inner surface of the end plate, said inner surface facing the other end plate, wherein the fixed and revolving scrolls are engaged with each other so as to form a plurality of compression chambers; a discharge cavity is limitedly provided by an outer surface of the end plate of the fixed scroll and the housing; a discharge port is opened in a central area in the end plate of the fixed scroll; and a gas compressed by the compression chambers is discharged via the discharge port and the discharge cavity by revolving the revolving scroll, and the scroll-type compressor further comprising two thermocouples, the contact point of one thermocouple being with a central portion of the end plate of the fixed scroll, while the contact point of the other thermocouple being with the housing; and means for terminating the operation of the scroll-type compressor when a difference between temperature values detected by the thermocouples reaches a predetermined value.

The present invention also provides a method of operating a scroll-type compressor having a structure as mentioned above. The method comprises the steps of detecting a difference between the temperature of a central portion of the end plate of the fixed scroll and the temperature of the housing; and terminating the operation of the scroll-type compressor when the temperature difference reaches a predetermined value.

According to the present invention, the contact point of one of the thermocouples is with a central portion of the end plate of the fixed plate, while the contact point of the other thermocouple is with the housing, and the operation of the scroll-type compressor is terminated when a temperature difference detected by the thermocouples reaches a predetermined value. Therefore, seizure or scuffing due to tight contact between the heads of the spiral laps and the inner surfaces of end plates can be avoided.

In addition, the contact point of one of the thermocouples is contact with the central portion of the end plate of the fixed scroll; thus, a rise in the temperature of the compressed gas in the compression chambers can be rapidly detected.

BRIEF DESCRIPTION OF THE DRAWINGS

FIG. 1A is a sectional view of the scroll-type compressor in the longitudinal direction, while FIG. 1B is a relevant circuitry diagram.

DESCRIPTION OF THE PREFERRED EMBODIMENTS

Figure 1B:
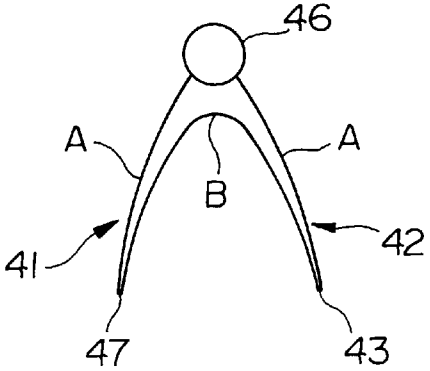
FIGS. 1A and 1B show a scroll-type compressor as an embodiment according to the present invention.
Figure 1A:
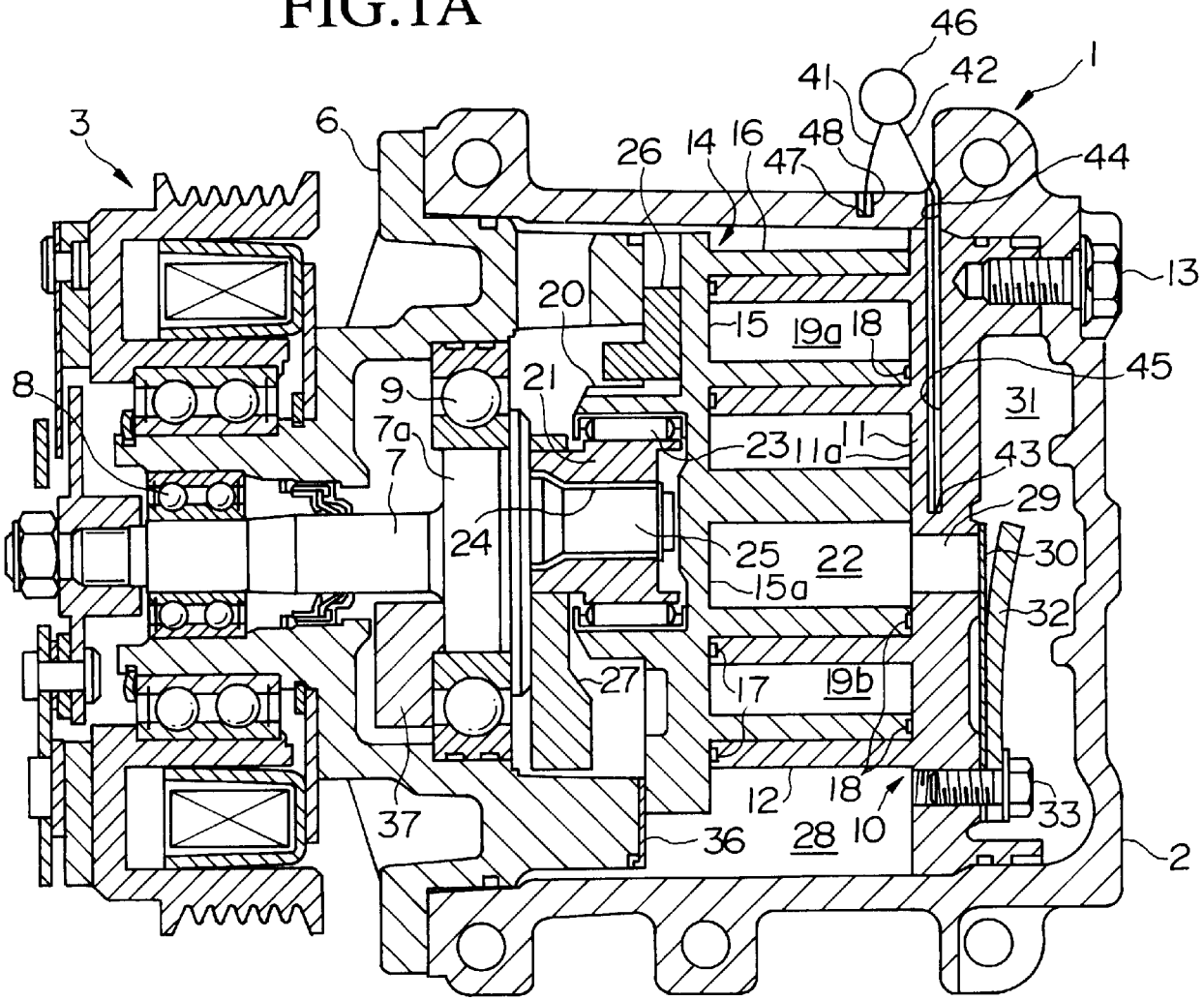

The first embodiment of the present invention is shown in FIGS. 1A and 1B. FIG. 1A is a sectional view in the longitudinal direction, which shows a scroll-type compressor as an embodiment according to the present invention, while FIG. 1B is a circuitry diagram.

As shown in FIG. 1A, thermocouple 42 is inserted into hole 44 opened in cup-like main body 2 of housing 1 and hole 45 opened in end plate 11 of fixed scroll 10. The contact point 43 as the head of thermocouple 42 is with a central portion of end plate 11 of the fixed scroll 10, while a base end of thermocouple 42 is connected to potential switch 46.

Another thermocouple 41 is inserted into hole 48 opened in the cup-like main body 2. The contact point 47 as the head of thermocouple 41 is with the bottom of hole 48, while a base end of thermocouple 42 is connected to potential switch 46.

As shown in FIG. 1B, each of thermocouples 41 and 42 consists of metal A and metal B. Both ends of metal B are connected with metal A via contact points 43 and 47, while each base-end of both lines of metal A is connected to potential switch 46.

Therefore, if the temperature of the contact point 43 of thermocouple 42 becomes different from the temperature of the contact point 47 of thermocouple 41, a voltage, generated by a potential difference corresponding to the thermal difference, is applied via metal A to potential switch 46. When the potential difference reaches a predetermined potential difference, the potential switch 46 outputs a signal to clutch 3 so as to disconnect the clutch.

Figure 2:
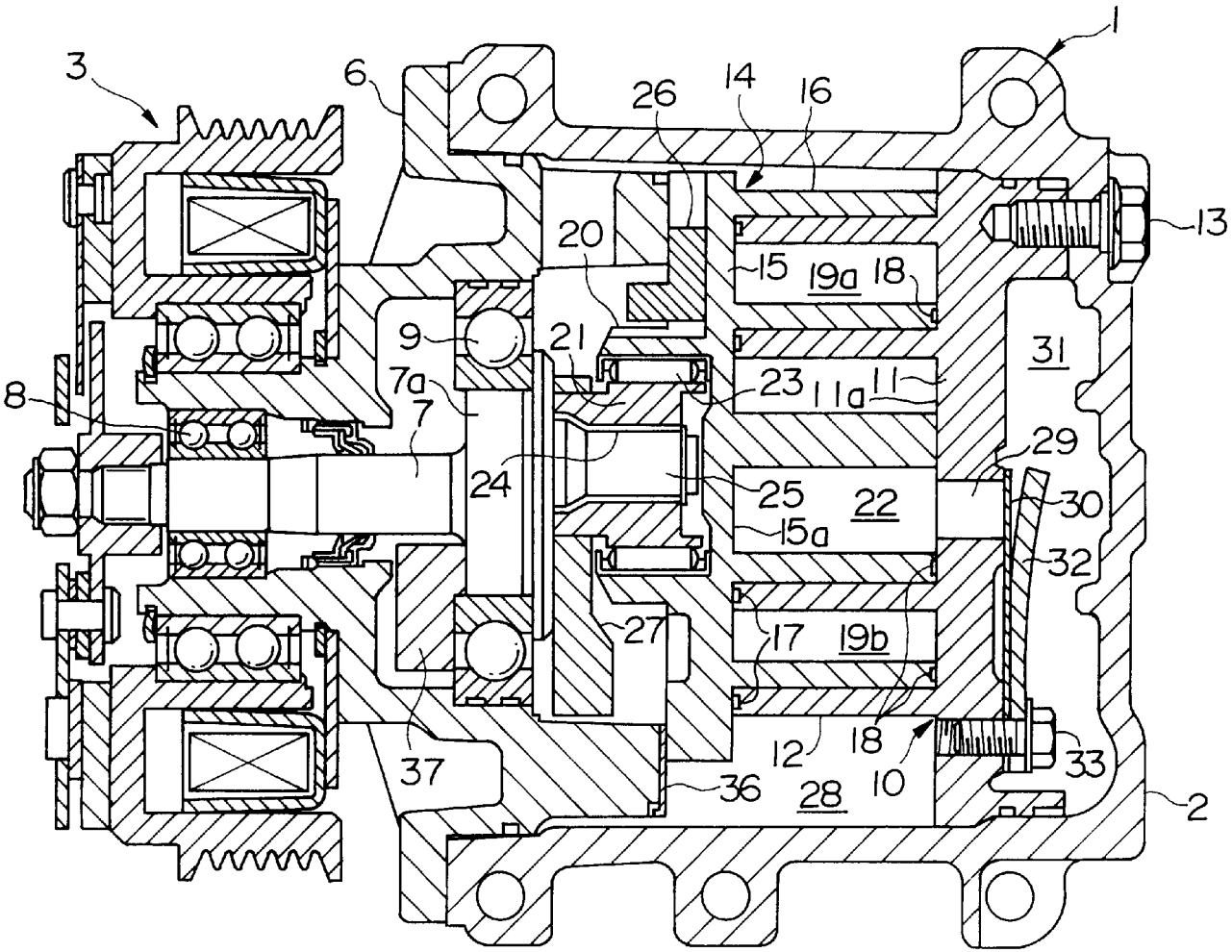
FIG.2 PRIOR ART
FIG. 2 is a sectional view in the longitudinal direction, which shows a conventional scroll-type compressor.

Other structural elements and functions are the same as those of the conventional compressor shown in FIG. 2, and parts which are identical to those shown in FIG. 2 are given identical reference numbers, and explanations thereof will be omitted here.

In the present embodiment, when the scroll-type compressor is accelerated very rapidly under operational conditions with a high compression ratio and the temperature of compression chambers 19*a* and 19*b* rises rapidly, the temperature of a central portion of end plate 11 of fixed scroll 10 also rises rapidly because discharge cavity 31 is limited by the end plate 11 and discharge port 29 is provided at the center of this end plate 11. However, the temperature of housing 1 is raised slowly.

If the temperature of the central portion of end plate 11 of fixed scroll 10, detected by thermocouple 42, becomes higher by a predetermined value than temperature of housing 1, detected by thermocouple 41, then clutch 3 is disconnected and operation of the scroll-type compressor is terminated. Therefore, seizure or scuffing due to tight contact between the heads of spiral laps 12 and 16 and the inner surfaces of end plates 15 and 11 can be avoided.

What is claimed is:

1. A scroll-type compressor comprising a housing, and a fixed scroll and a revolving scroll in the housing, each scroll comprising an end plate and a spiral lap built on an inner surface of the end plate, said inner surface facing the other end plate, wherein:

the fixed and revolving scrolls are engaged with each other so as to form a plurality of compression chambers;

a discharge cavity is limitedly provided by an outer surface of the end plate of the fixed scroll and the housing;

a discharge port is opened in a central area in the end plate of the fixed scroll; and a gas compressed by the compression chambers is discharged via the discharge port and the discharge cavity by revolving the revolving scroll, and the scroll-type compressor further comprising:

two thermocouples, the contact point of one thermocouple being with a central portion of the end plate of the fixed scroll, while the contact point of the other thermocouple being with the housing; and means for terminating the operation of the scroll-type compressor when a difference between temperature values detected by the thermocouples reaches a predetermined value.

2. A method of operating a scroll-type compressor which comprises a housing, and a fixed scroll and a revolving scroll in the housing, each scroll comprising an end plate and a spiral lap built on an inner surface of the end plate, said inner surface facing the other end plate, wherein the fixed and revolving scrolls are engaged with each other so as to form a plurality of compression chambers; a discharge cavity is limitedly provided by an outer surface of the end plate of the fixed scroll and the housing; a discharge port is opened in a central area in the end plate of the fixed scroll; and a gas compressed by the compression chambers is discharged via the discharge port and the discharge cavity by revolving the revolving scroll, and the method comprising the steps of:

detecting a difference between the temperature of a central portion of the end plate of the fixed scroll and the temperature of the housing; and terminating the operation of the scroll-type compressor when the temperature difference reaches a predetermined value.

* * * * *